United States Patent [19]

Novak

[11] 4,408,569

[45] Oct. 11, 1983

[54] CONTROL OF A FURNACE

[75] Inventor: Danny E. Novak, Bartlesville, Okla.

[73] Assignee: Phillips Petroleum Company, Bartlesville, Okla.

[21] Appl. No.: 322,614

[22] Filed: Nov. 18, 1981

[51] Int. Cl.[3] ..... F22B 37/42; F22D 5/00

[52] U.S. Cl. ..... 122/448 R; 236/14; 236/15 BD; 236/15 E; 431/12; 431/76

[58] Field of Search ..... 122/448 R; 431/12, 76, 431/90; 236/14, 15 BD, 15 E

[56] References Cited

U.S. PATENT DOCUMENTS

| | | | |
|---|---|---|---|
| 3,074,644 | 1/1963 | Geniesse | 431/76 |
| 3,415,232 | 12/1968 | Garrett et al. | 122/448 R |
| 4,097,218 | 6/1978 | Womack | 431/76 |
| 4,162,889 | 7/1979 | Shigemura | 431/76 |
| 4,309,949 | 1/1982 | Rastogi | 431/76 |
| 4,330,261 | 5/1982 | Sun | 431/76 |

*Primary Examiner*—Edward G. Favors
*Assistant Examiner*—Steven E. Warner

[57] ABSTRACT

The efficiency of a furnace is substantially maximized by manipulating the amount of oxygen supplied to the combustion process in the furnace so as to provide a desired oxygen concentration in the flue gas which will result in substantially maximum furnace efficiency. Feed forward control based on the fuel flow rate may also be utilized to enable the control based on oxygen concentration in the flue gas to respond more quickly to a change in the fuel flow rate.

17 Claims, 4 Drawing Figures

CONTROL OF A FURNACE

This invention relates to furnace control. In one aspect this invention relates to method and apparatus for maintaining an oxygen concentration in the furnace flue gas which will result in maximum furnace efficiency. In another aspect this invention relates to method and apparatus for providing feed forward control for a furnace which allows the amount of oxygen provided to the furnace to be changed rapidly in response to a change in the fuel flow rate so as to maintain a desired oxygen concentration in the flue gas.

Furnaces are utilized in many processes to supply heat to process streams. A fuel is typically provided to the furnace with the combustion of such fuel supplying heat which is transferred to the process stream. The ratio between the heat absorbed by the process stream and the heat supplied in the form of fuel to the furnace is typically referred to as the "efficiency" of the furnace. In order to operate a combustion process efficiently, the combustion components (oxygen and fuel) must be supplied in proportions which allow complete combustion without a substantial excess of free oxygen in the combustion products. The oxygen concentration in the flue gas is thus a variable which may be manipulated to control the efficiency of a furnace and it is an object of this invention to provide method and apparatus for maintaining an oxygen concentration in the flue gas which will result in maximum furnace efficiency.

Changes in the flow rate of fuel to a furnace must be responded to rapidly by increasing or decreasing the oxygen supply to the combustion process if furnace efficiency is to be maintained at a substantially maximum level. Control based solely on the oxygen concentration in the flue gas may not be able to respond quickly to changes in the fuel flow rate since such changes will not affect the oxygen concentration in the flue gas for a period of time which is determined by the furnace construction. It is thus another object of this invention to provide method and apparatus for providing feed forward control for a furnace which allows the amount of oxygen provided to the furnace to be changed rapidly in response to a change in the fuel flow rate.

In accordance with the present invention, method and apparatus is provided for determining a desired oxygen concentration in the flue gas which will result in a substantially maximum furnace efficiency. The desired oxygen concentration may then be compared to an actual measured oxygen concentration to derive a control signal which is utilized to manipulate the amount of air supplied to the combustion process in the furnace so as to maintain the actual oxygen concentration substantially equal to the oxygen concentration which will result in substantially maximum furnace efficiency.

Feed forward control based on the fuel flow rate may be utilized to enable the control based on oxygen concentration in the flue gas to respond more quickly to a change in fuel flow rate if desired. Essentially, a control signal representative of a change in oxygen which must be provided to the combustion process in response to a change in fuel flow rate is derived based on the actual fuel flow rate. This control signal may be utilized to bias the primary control signal which is based on a comparison of actual oxygen concentration to desired oxygen concentration to provide a quick response to changes in fuel flow rate. If the fuel flow rate is at steady state, then the feed forward control will not affect the primary control based on oxygen concentration in the flue gas.

Other objects and advantages of the invention will be apparent from the foregoing brief description of the invention and the claims as well as the detailed description of the drawings in which:

The invention is illustrated and described in terms of a very simple furnace configuration for the sake of clarity. It should be noted however that the invention is applicable to different furnace configurations and may be applied to multiple furnaces if desired. Also, the furnace might contain multiple burners, and, stacks and multiple process streams may be provided to the furnace. Also, the furnace might be used for a large variety of purposes besides heating process streams.

Figure 1:
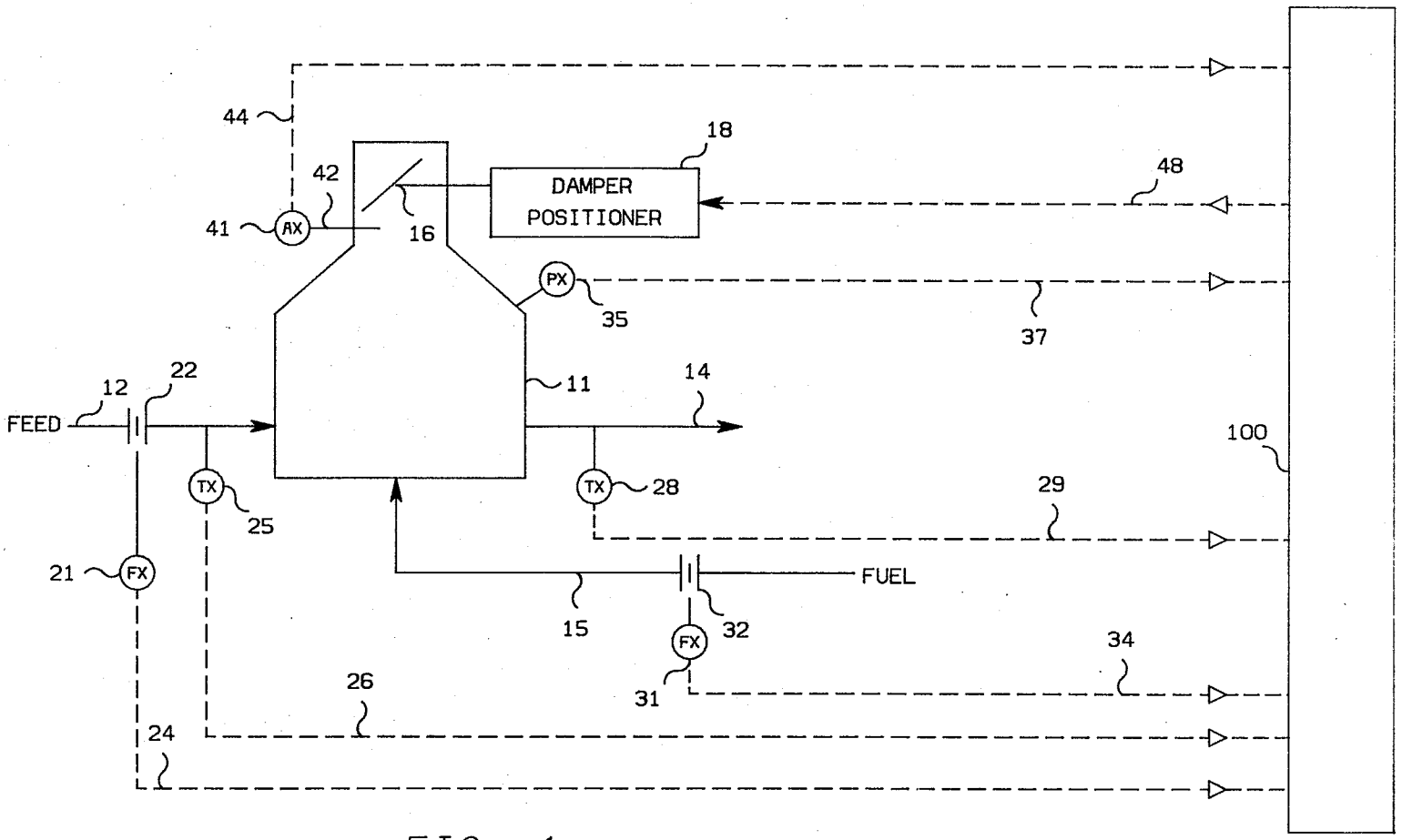
FIG. 1 is a diagrammatic illustration of a furnace for heating a process stream and the associated control system of the present invention.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from flow sensors will generally be pneumatic in form. Transducing of these signals is not illustrated for the sake of simplicity because it is well known in the art that if a flow is measured in pneumatic form it must be transduced to electrical form if it is to be transmitted in electrical form by a flow transducer. Also, transducing of the signals from analog form to digital form or from digital form to analog form is not illustrated because such transducing is also well known in the art.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signals based on measured process parameters as well as set points supplied to the computer. Analog computers or other types of computing devices could also be used in the invention. The digital computer is preferably an OPTROL 7000 Process Computer System from Applied Automation, Inc., Bartlesville, Okla.

Signal lines are also utilized to represent the results of calculations carried out in a digital computer and the term "signal" is utilized to refer to such results. Thus, the term signal is used not only to refer to electrical currents or pneumatic pressures but is also used to refer to binary representations of a calculated or measured value.

Both the analog and digital controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, or signals derived from one or both of the two input signals is within the scope of the invention.

The scaling of an output signal by a controller is well known in control system art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to the drawings and in particular to FIG. 1, there is illustrated a furnace 11. A fluid stream is provided to the furnace 11 through conduit means 12 and is withdrawn through conduit means 14. Fuel is supplied to the furnace through conduit means 15 with the combustion of the fuel being utilized to provide heat to the process stream flowing through conduit means 12. The damper 16, the position of which is controlled by the damper positioner 18, is utilized to control the amount of oxygen which is provided to the combustion process in the furnace 11. Typically, air will be utilized to provide oxygen to the combustion process but any fluid containing free oxygen may be utilized if desired.

As described to this point, the furnace 11 is a conventional furnace such as might be found in a number of different processes. As has been previously stated, more than one process stream or fuel stream might be provided to the furnace 11. Also, the position of the damper 16 might be different. However, the novelty of the present invention resides in the control system and such control system may be applied to any furnace where it is possible to control the amount of oxygen supplied to the combustion process and where it is possible to determine the furnace efficiency.

Flow transducer 21 in combination with the flow sensor 22, which is operably located in conduit means 12, provides an output signal 24 which is representative of the actual flow rate of the fluid flowing through conduit means 12. Signal 24 is provided from the flow transducer 21 as an input to computer means 100.

Temperature transducer 25 in combination with a temperature measuring device such as a thermocouple, which is operably located in conduit means 12, provides an output signal 26 which is representive of the temperature of the fluid flowing through conduit means 12. Signal 26 is provided from the temperature transducer 25 as an input to computer means 100. In like manner, temperature transducer 28 in combination with a temperature measuring device such as a thermocouple, which is operably located in conduit means 14, provides an output signal 29 which is representative of the temperature of the fluid flowing through conduit means 14. Signal 29 is provided from the temperature transducer 28 as an input to computer means 100.

Flow transducer 31 in combination with the flow sensor 32, which is operably located in conduit means 15, provides an output signal 34 which is representative of the actual flow rate of the fuel flowing through conduit means 15. Signal 34 is provided from the flow transducer 31 as an input to computer means 100.

Pressure transducer 35 in combination with a pressure sensing device, which is operably located in furnace 11, provides an output signal 37 which is representative of the pressure in the furnace 11. Signal 37 is provided from the pressure transducer 35 as an input to computer means 100.

The analyzer transducer 41 is an oxygen analyzer. The analyzer transducer 41 may be an Optichrom 2100 Chromatographic Analyzer manufactured by Applied Automation, Inc., Bartlesville, Okla. A sample of the flue gas is provided through conduit means 42 to the analyzer transducer 41. The analyzer transducer 41 analyzes the flue gas and provides an output signal 44 which is representative of the concentration of oxygen in the flue gas. Signal 44 is provided from the analyzer transducer 41 as an input to computer means 100.

In response to the described input signals and various set point signals which will be described more fully hereinafter, computer means 100 provides an output signal 48 which is representative of the change in position of the damper 16 required to maintain an oxygen concentration in the flue gas which will result in substantially maximum furnace efficiency. Signal 48 is supplied from computer means 100 to the damper positioner 18 and is utilized to manipulate the position of damper 16.

Figure 2:
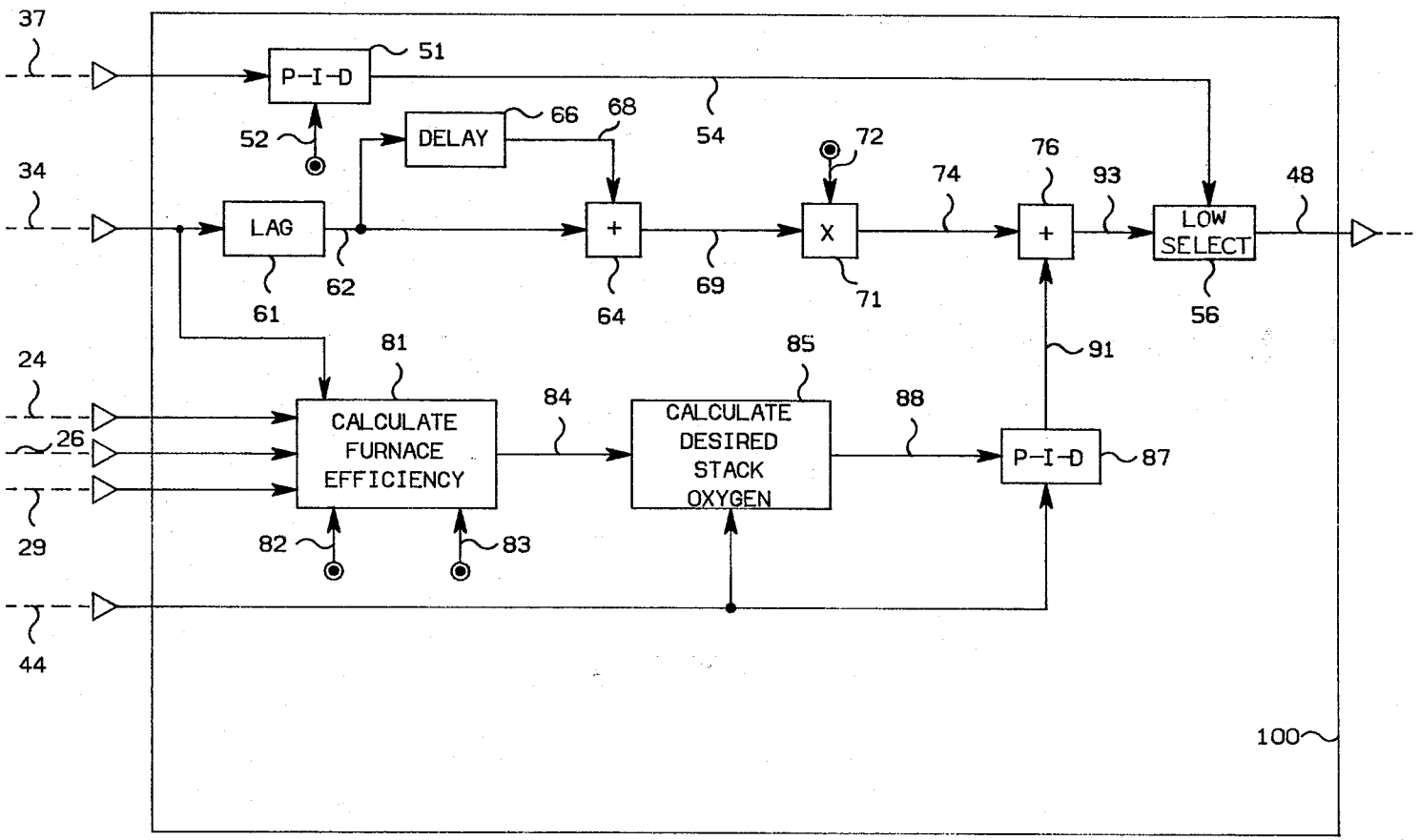
FIG. 2 is a logic diagram for the computer logic utilized to generate the control signal illustrated in FIG. 1.

The following discussion regarding the calculation of the actual furnace efficiency and the concentration of oxygen in the flue gas which results in maximum furnace efficiency is provided to simplify the computer logic illustrated in FIG. 2 and illustrate the basis for calculations. As has been previously stated, the furnace efficiency is given by the ratio of the heat absorbed by the process stream flowing through conduit means 12 to the heat released by the fuel flowing through conduit means 15. The heat absorbed by the process is given by $$H_p=(F_p)(C_p)(T_2-T_1) \quad (1)$$

where:

$H_p$=heat absorbed by process stream flowing through conduit means 12;

$F_p$=flow rate of process stream;

$C_p$=specific heat of process stream;

$T_2$=temperature of fluid flowing through conduit means 14; and $T_1$=temperature of fluid flowing through conduit means 12.

$T_2$ is provided by signal 29 while $T_1$ is provided by signal 26. Signal 24 is utilized to provide $F_p$. The specific heat $C_p$ of the process stream will generally be known and may be entered by an operator.

The heat released by the fuel is given by $$H_g=(F_g)(\mathrm{BTU}_g) \quad (2)$$

where:

$H_g$=heat released by the fuel;

$F_g$=flow rate of fuel; and $\mathrm{BTU}_g$=the number of BTU's which may be obtained by combusting a given volume of fuel.

$F_g$ is supplied by a signal 34. In general, the BTU content of the fuel will be known and may be entered by an operator. However, if the BTU content is unknown or is fluctuating as a function of time, then a BTU analyzer may be utilized to provide the BTU content of the fuel flowing through conduit maans 15.

The efficiency of the furnace 11 is given by $$EFF=(H_p/H_g)(100)$$

where:

EFF=percentage efficiency of the furnace 11; and $H_p$ and $H_g$ are as previously defined.

The logic flow diagram utilized to calculate the control signal 48 in response to the previously described input signals to computer means 100 and in response to set point signals which will be fully described hereinafter is illustrated in FIG. 2. Referring now to FIG. 2, computer means 100 is shown as a solid line surrounding the flow logic.

Signal 37, which is representative of the actual pressure in the furnace 11, is provided as the process variable input to the proportional-integral-derivative (P-I-D) controller block 51. The P-I-D controller block 51 is also provided with a set point signal 52 which is representative of the maximum allowable pressure in the furnace 11. The magnitude of signal 52 will generally be determined by metallurgical considerations or safety factors. The P-I-D controller block 51 provides an output signal 54 which is responsive to the difference between signals 37 and 52. Signal 54 will be scaled so as to be representative of the change in position of the damper 16 required to maintain the actual pressure in the furnace 11 substantially equal to the maximum desired pressure represented by signal 52. Signal 54 is provided from the P-I-D controller block 51 as an input to the low select block 56. signal 54 is essentially used as a safety control signal which prevents the primary control system of the present invention from allowing the position of the damper 16 to create a pressure in the furnace 11 which is above the pressure limitation represented by signal 52.

Signal 34, which is representative of the flow rate of the fuel flowing through conduit means 15, is provided as an input to the lag block 61 and as an input to the calculate furnace efficiency block 81. It is noted that signal 34 will change periodically to update the value of the fuel flow rate (updating every 5 seconds is presently preferred). The most current value for the fuel flow rate is used for the feedforward control while one value of the fuel flow rate every minute is used to calculate the furnace efficiency as will be described more fully hereinafter. Other frequencies could be used if desired.

The lag block 61 is utilized to account for the time delay required for the fuel to flow from the point where the fuel flow rate is measured to the point where the fuel is combusted in the furnace 11. The output signal 62 from the lag 61 will thus be representative of the flow rate of the fuel delayed by the time constant of the lag 61. The time required for the fuel to flow from the point where the fuel flow rate is measured to the point where the fuel is combusted is generally reasonably well known at least to the extent that the delay required by the lag 61 can be estimated with reasonable accuracy. Signal 62 is provided from the lag 61 to the minuend input of the summing block 64 and is also provided as an input to the delay block 66. The output signal 68 from the delay block 66 is provided to the subtrahend input of the summing block 64. The delay box 66 is utilized to cancel the effect of signal 62 over a period of time. The manner in which this is accomplished will be described more fully hereinafter.

The magnitude of signal 68 is subtracted from the magnitude of signal 62 to establish signal 69. Signal 69 is provided from the summing block 64 as an input to the multiplying block 71. The multiplying block 71 is also provided with signal 72 which is representative of the volume of air which must be provided per unit volume of the fuel flowing through conduit means 15. Signal 72 is multiplied by signal 69 to establish signal 74 which is provided from the multiplying block 71 as an input to the summing block 76. Signal 74 is utilized as a feed forward bias signal as will be described more fully hereinafter.

If it is assumed that the flow rate of the fuel flowing through conduit means 15 is at steady state, then the output signal 69 from the summing block 64 will be zero and the magnitude of signal 74 will be zero. Now, assuming that a change occurs in the flow rate of the fuel flowing through conduit means 15, signal 69 will assume some magnitude because signal 62 will have changed more quickly than signal 68 because of the action of the delay block 66. This will in turn cause signal 74 to assume a magnitude. Thus, a very quick response is provided to a change in the fuel flow rate. Signal 68 will slowly change until the value of signal 68 is substantially equal to the magnitude of signal 62. The magnitude of signal 69 and 74 will slowly decrease as this occurs until steady state is again reached and the magnitude of signal 69 and 74 is again zero.

Signal 24, which is representative of the flow rate of the fluid flowing through conduit means 12, is provided as an input to the calculate furnace efficiency block 81. In like manner signals 26 and 29, which are representative of the temperature of the fluid stream flowing through conduit means 12 and the temperature of the fluid stream flowing through conduit means 14 respectively, are provided to the calculate furnace efficiency block 81. The calculate furnace efficiency block 81 is also supplied with two signals 82 and 83 which are representative of the specific heat of the fluid stream flowing through conduit means 12 and the number of BTU's which may be obtained by combusting a given volume of fuel respectively. The furnace efficiency is calculated as has been previously described and is provided as signal 84 from the calculate furnace efficiency block 81 to the calculate desired stack oxygen block 85.

The calculate desired stack oxygen block 85 is also provided with signal 44 which is representative of the concentration of oxygen in the stack or flue gas. Signal 44 is also provided as an input to the P-I-D controller block 87. As in the case of signal 34, signal 44 will change periodically to update the value of the actual concentration of oxygen in the flue gas (again, updating every 5 seconds is presently preferred). The most current value for the actual concentration of oxygen in the flue gas is used by the P-I-D controller block 87 while one value of the actual concentration of oxygen in the flue gas every minute is used to calculate the desired stack oxygen as will be described more fully hereinafter. Again, other frequencies could be used if desired.

The desired concentration of oxygen in the flue gas is calculated in the calculate desired stack oxygen block 85 as will be described more fully hereinafter, and is provided as signal 88 to the P-I-D controller block 87. The P-I-D controller block 87 provides an output signal 91 which is responsive to the difference between signals 88 and 44. Signal 91 will be scaled so as to be representative of the change in position of the damper 16 required to maintain the magnitude of signal 44 substantially equal to the magnitude of signal 88. Signal 91 is provided as an input to the summing block 76.

Signal 91 is summed with signal 74 to establish signal 93. Signal 93 will be representative of a desired change in damper position. Signal 91 may be biased by signal 74 if the fuel flow rate changes. Signal 93 is provided from the summing block 76 to the low select block 56.

The low select block 56 selects the lower of signals 54 and 93 to be provided as the control signal 48. Signal 48 is provided as an output from computer means 100 and is utilized as has been previously described. In general, signal 48 will be equal to the magnitude of signal 93. Only when the magnitude of signal 93 would force the damper to a position which would cause a pressure limitation in the furnace 11 to be exceeded will signal 54 be selected by the low select 56.

Figure 3:
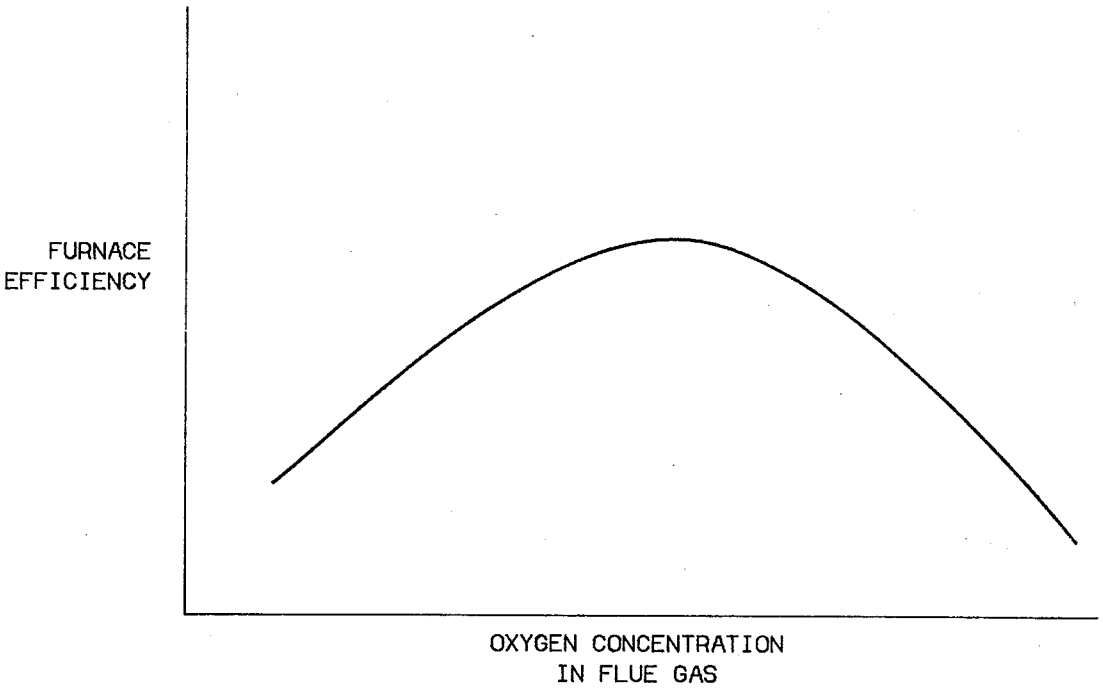
FIG. 3 is a general plot of furnace efficiency versus oxygen concentration in the furnace flue gas.

A general plot of furnace efficiency versus oxygen concentration in the flue gas is illustrated in FIG. 3. It has been found that the curve illustrated in FIG. 3 will change as a function of the operating conditions for a furnace. Thus, the optimum oxygen concentration will change as a function of furnace operating conditions. The present invention utilizes an optimization method to determine the optimum oxygen concentration in the flue gas.

In general, the optimization method requires establishing at least two points on the plot illustrated in FIG. 3. Each point may be established by a single calculation of furnace efficiency for a particular time period and a single measurement of stack oxygen concentration for that particular time period. However, preferably an averaging technique is used to establish each point for the sake of accuracy. A preferred procedure for establishing each point is as follows.

The furnace efficiency is calculated for a time period $T_1$. The stack oxygen concentration for the time period $T_1$ is provided by the analyzer 41 illustrated in FIG. 1. The furnace efficiency is then again calculated for a time period $T_2$ and the stack oxygen concentration is measured for the time period $T_2$. The two efficiency values are averaged to obtain a single average efficiency and the two stack oxygen values are averaged to obtain a single stack oxygen value. Subsequent values of efficiency and stack oxygen concentration are averaged into these two values for a total of twenty time periods to establish one point on the plot illustrated in FIG. 3. Each time period is preferably one minute. Therefore, after a period of twenty minutes, one set of coordinates has been developed and can be represented as a point on the plot illustrated in FIG. 3.

The averaging of a number of sampled points is very important in order to reduce the uncertainty caused by process disturbances and inaccurate process measurements. Twenty sample points are used in the present invention but other suitable numbers could be used if desired.

After five twenty minute time periods, five points are established on the plot illustrated in FIG. 3. As each new point is developed every twenty minutes it is added to the list of five points and the oldest in the list is omitted. At the end of each twenty minute period a linear regression is performed on the five points of the list. The slope of the resulting line is calculated.

The use of five points is preferred for the sake of accuracy in a noisy environment. As few as two points may be used but accuracy may suffer if process noise causes inaccurate process measurements.

The specific steps within the slope calculation are as follows for each program interval.

(1) Maintain a running average of the calculated efficiency and the measured oxygen value.

(2) After a fixed number of intervals, store the running average in a shiftdown table of desired length.

(3) After (2) above, an optimization pass is made. The sign of the fixed stepsize that is to be added to the oxygen set point is determined by:

$$\frac{\Sigma(X_i - \overline{X})(Y_i - \overline{Y})}{|\Sigma(X_i - \overline{X})(Y_i - \overline{Y})|}$$

where $X_i$=running averages of oxygen from the shiftdown table;

$\overline{X}$=average of the $X_i$;

$Y_i$=running averages of furnace efficiency from the shiftdown table; and $\overline{Y}$=average of the $Y_i$.

Figure 4:
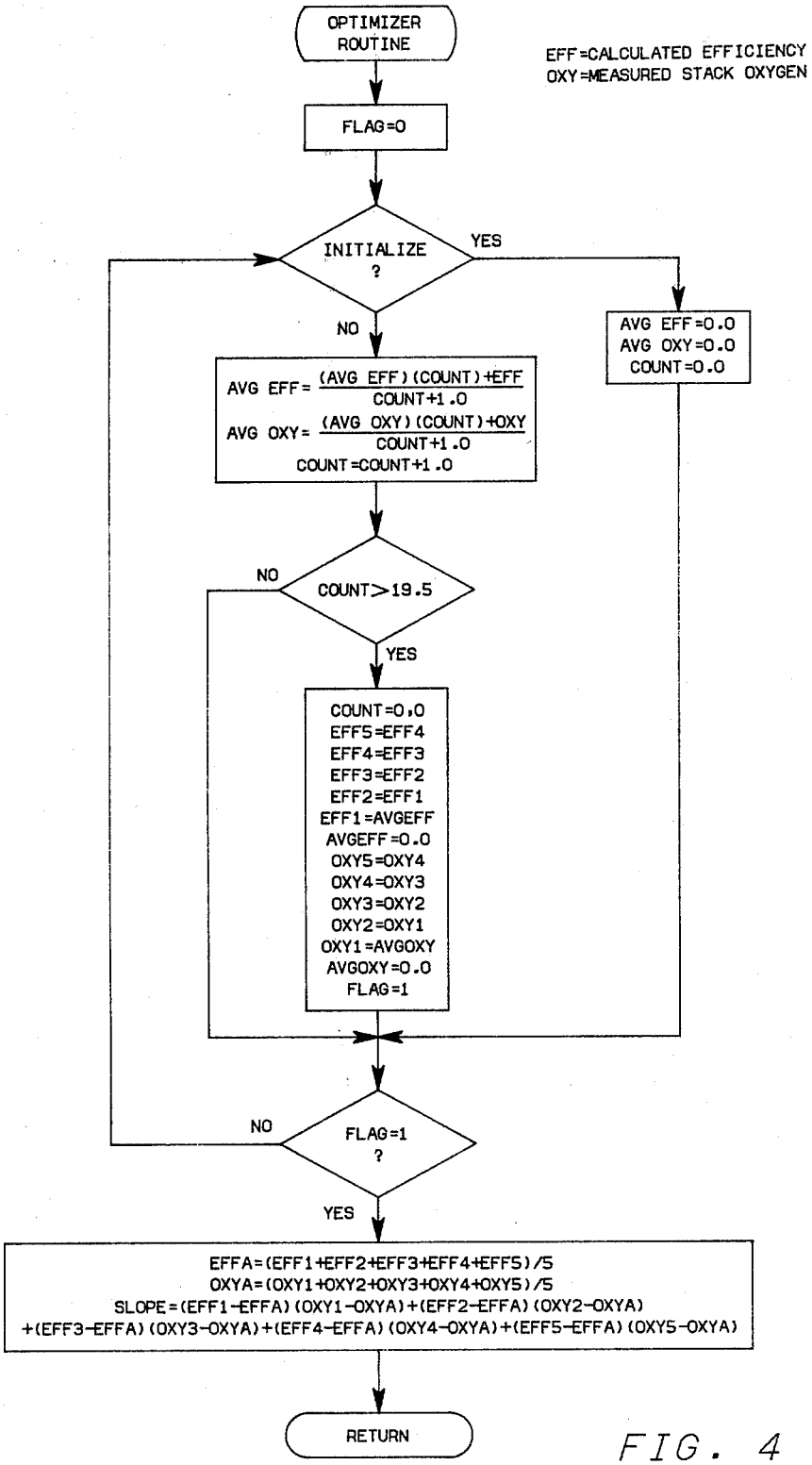
FIG. 4 is a logic diagram of a program which may be utilized to calculate the sign of the slope of the efficiency curve at the point on the curve at which the furnace is operating.

A number of routines could be utilized to accomplish steps (1)–(3) above. The logic flow of a preferred routine is illustrated in FIG. 4.

If the slope is positive, then the desired stack oxygen is increased by a desired incremental value (preferably about 10% of the actual stack oxygen concentration). If the slope is negative then the desired stack oxygen is decreased by the desired increment. This process is continued until the optimum stack oxygen concentration is found. At this point, the stack oxygen concentration will be allowed to move about the optimum oxygen concentration by the fixed step size in such a manner that, if the optimum oxygen concentration changes, the control system is able to track the optimum oxygen concentration.

It is noted that, for the described preferred embodiment, the magnitude of signal 48 may change every 5 seconds because of the action of signals 34, 37 and 44 which are updated every 5 seconds. However, the value of the set point signal 88 will only change every 20 minutes because of the averaging technique used to establish signal 88.

The invention has been illustrated and described in terms of a preferred embodiment as illustrated in FIGS. 1–4. Specific components which can be used in the practice of the invention as illustrated in FIG. 1 such as flow transducers 21 and 31; flow sensors 22 and 32; temperature transducers 25 and 28 and pressure transducer 35 are each well known, commercially available control components such as are illustrated and described at length in Perry's Chemical Engineers Handbook, Fourth edition, Chapter 22, McGraw Hill.

While the invention has been described in terms of the presently preferred embodiment, reasonable variations and modifications are possible by those skilled in the art as has been previously discussed. Such variations and modifications are within the scope of the described invention and the appended claims.

That which is claimed is:

1. Apparatus for controlling the amount of oxygen supplied to a combustion zone in a furnace comprising:

means for establishing a first signal representative of the calculated efficiency of said furnace during a first time period;

means for establishing a second signal representative of the actual oxygen concentration in the furnace flue gas during said first time period;

means for establishing a third signal representative of the calculated efficiency of said furnace during a second time period, wherein said second time period is later in time then said first time period and wherein the amount of oxygen supplied to said combustion zone in said furnace has been changed after said first time period;

means for establishing a fourth signal representative of the actual oxygen concentration in said furnace flue gas during said second time period;

means for establishing a fifth signal representative of the desired oxygen concentration in said furnace flue gas during a third time period in response to said first, second, third and fourth signals, wherein said third time period is later in time then said second time period;

means for establishing a sixth signal representative of the most current measurement of the actual oxygen concentration in said furnace flue gas;

means for comparing said fifth signal and sixth signal and for establishing a control signal which is responsive to the difference between said fifth signal and said sixth signal; and means for manipulating the amount of oxygen supplied to said combustion zone during said third time period in response to said control signal.

2. Apparatus in accordance with claim 1 wherein said first signal is the average of a plurality of furnace efficiencies calculated periodically during said first time period, wherein said second signal is the average of a plurality of actual oxygen concentrations in the furnace flue gas measured periodically during said first time period, wherein said third signal is the average of a plurality of furnace efficiencies calculated periodically during said second time period, and wherein said fourth signal is the average of a plurality of actual oxygen concentrations in said furnace flue gas measured periodically during said second time period.

3. Apparatus in accordance with claim 2 wherein a fuel is provided to said furnace with the combustion of said fuel being utilized to supply heat to a fluid stream flowing through said furnace and wherein said means for establishing said first signal and said third signal comprises:

means for establishing a plurality of seventh signals representative of the heat absorbed by said fluid stream in said furnace per unit time for different time periods during said first time period;

means for establishing a plurality of eighth signals representative of the heat absorbed by said fluid stream in said furnace per unit time for different time periods during said second time period;

means for establishing a plurality of ninth signals representative of the heat provided to said furnace by the combustion of said fuel per unit time for different time periods during said first time period which correspond to the different time periods for the establishing of said plurality of seventh signals;

means for establishing a plurality of tenth signals representative of the heat provided to said furnace by the combustion of said fuel per unit time for different time periods during said second time period which correspond to the different time periods for the establishing of said plurality of eighth signals;

means for dividing corresponding ones of said plurality of seventh signals by corresponding ones of said plurality of ninth signals to establish said first signal and for dividing corresponding ones of said plurality of eighth signals by corresponding ones of said plurality of tenth signals; and means for averaging the results of the division of said plurality of seventh signals by said plurality of ninth signals to establish said first signal and for averaging the results of the division of said plurality of eighth signals by said plurality of tenth signals to establish said third signal.

4. Apparatus in accordance with claim 3 wherein means for establishing a particular one of said plurality of seventh and eighth signals comprises:

means for establishing an eleventh signal representative of the flow rate ($F_p$) of said fluid stream;

means for establishing a twelfth signal representative of the specific heat ($C_p$) of said fluid stream;

means for multiplying said eleventh signal by said twelfth signal to establish a thirteenth signal representative of ($F_p$) ($C_p$);

means for establishing a fourteenth signal representative of temperature $T_0$ of the fluid stream as said fluid stream flows from said furnace;

means for establishing a fifteenth signal representative of the temperature $T_i$ of said fluid stream before said fluid stream enters said furnace;

means for subtracting said fifteenth signal from said fourteenth signal to establish a sixteenth signal representative of $(T_0-T_i)$; and means for multiplying said thirteenth signal by said sixteenth signal to establish a particular one of said plurality of seventh and eighth signals.

5. Apparatus in accordance with claim 4 wherein means for establishing a particular one of said plurality of ninth and tenth signals comprises:

means for establishing a seventeenth signal representative of flow rate ($F_9$) of said fuel to said furnace;

means for establishing an eighteenth signal representative of the BTU content ($BTU_g$) of a unit volume of said fuel; and means for multiplying said seventeenth signal by said eighteenth signal to establish a particular one of said plurality of ninth and tenth signals.

6. Apparatus in accordance with claim 1 additionally comprising:

means for establishing a seventh signal representative of the most current measurement of the flow rate of said fuel;

lag means;

means for providing said seventh signal through said lag means to thereby establish an eighth signal;

delay means;

means for passing said eighth signal through said delay means to thereby establish a ninth signal;

means for subtracting said ninth signal from said eighth signal to establish a tenth signal;

means for establishing an eleventh signal representative of the volume of air which must be provided to said furnace per unit volume of said fuel;

means for multiplying said tenth signal and said eleventh signal to establish a twelth signal; and means for biasing said control signal with said twelfth signal.

7. Apparatus in accordance with claim 6 wherein a damper is utilized to manipulate the flow of oxygen to said combusition zone and wherein said control signal biased with said twelfth signal is scaled so as to be representative of the change of position of said damper required to provide an actual oxygen concentration in said furnace flue gas substantially equal to the desired oxygen concentration represented by said fifth signal.

8. Apparatus in accordance with claim 7 additionally comprising:

means for establishing a thirteenth signal representative of the most current measurement of the pressure in said furnace;

means for establishing a fourteenth signal representative of the maximum allowable pressure in said furnace;

means for comparing said thirteenth signal and said fourteenth signal and for establishing a fifteenth signal which is responsive to the difference between said thirteenth signal and said fourteenth signal, wherein said fifteenth signal is scaled so as to be representative of the change of position of said damper which will maintain said actual pressure substantially equal to the maximum allowable actual pressure;

low select means;

means for providing said fifteenth signal and said control signal biased by said twelfth signal to said low select means, said low select means selecting the lower of said thirteenth signal and said control signal biased by said twelfth signal to establish a sixteenth signal; and means for manipulating the position of said damper in response to said sixteenth signal.

9. A method for controlling the amount of oxygen supplied to a combustion zone in a furnace, said method comprising the steps of:

establishing a first signal representative of the calculated efficiency of said furnace during a first time period;

establishing a second signal representative of the actual oxygen concentration in the furnace flue gas during said first time period;

establishing a third signal representative of the calculated efficiency of said furnace during a second time period, wherein said second time period is later in time then said first time period and wherein the amount of oxygen supplied to said combustion zone in said furnace has been changed after said first time period;

establishing a fourth signal representative of the actual oxygen concentration in said furnace flue gas during said second time period;

establishing a fifth signal representative of the desired oxygen concentration in said furnace flue gas during a third time period in response to said first, second, third and fourth signals, wherein said third time period is later in time then said second time period;

establishing a sixth signal representative of the most current measurement of the actual oxygen concentration in said furnace flue gas;

comparing said fifth signal and sixth signal and for establishing a control signal which is responsive to the difference between said fifth signal and said sixth signal; and manipulating the amount of oxygen supplied to said combustion zone during said third time period in response to said control signal.

10. A method in accordance with claim 9 wherein said first signal is the average of a plurality of furnace efficiencies calculated periodically during said first time period, wherein said second signal is the average of a plurality of actual oxygen concentrations in the furnace flue gas measured periodically during said first time period, wherein said third signal is the average of a plurality of furnace efficiencies calculated periodically during said second time period, and wherein said fourth signal is the average of a plurality of actual oxygen concentrations in said furnace flue gas measured periodically during said second time period.

11. A method in accordance with claim 10 wherein said first and second signals establish a point on a plot of furnace efficiency as a function of oxygen concentration in said furnace flue gas, wherein said third and fourth signals establish a second point on said plot, and wherein said step of establishing said fifth signal comprises the steps of:

determining the slope of a line between the point determined for said time $T_1$ and the point determined for the time $T_2$ on said plot;

increasing the desired oxygen concentration during said time period $T_2$ by a desired incremental value to establish said fifth signal if the slope of said line is positive; and decreasing the desired oxygen concentration during said time period $T_2$ by said desired incremental value to establish said fifth signal if the slope of said line is negative.

12. A method in accordance with claim 10 wherein a fuel is provided to said furnace with the combustion of said fuel being utilized to supply heat to a fluid stream flowing through said furnace and wherein said steps of establishing said first signal and said third signal comprises:

establishing a plurality of seventh signals representative of the heat absorbed by said fluid stream in said furnace per unit time for different time periods during said first time period;

establishing a plurality of eighth signals representative of the heat absorbed by said fluid stream in said furnace per unit time for different time periods during said second time period;

establishing a plurality of ninth signals representative of the heat provided to said furnace by the combustion of said fuel per unit time for different time periods during said first time period which correspond to the different time periods for the establishing of said plurality of seventh signals;

establishing a plurality of tenth signals representative of the heat provided to said furnace by the combustion of said fuel per unit time for different time periods during said second time period which correspond to the different time periods for the establishing of said plurality of eighth signals;

dividing corresponding ones of said plurality of seventh signals by corresponding ones of said plurality of ninth signals to establish said first signal and for dividing corresponding ones of said plurality of eighth signals by corresponding ones of said plurality of tenth signals; and averaging the results of the division of said plurality of seventh signals by said plurality of ninth signals to establish said first signal and for averaging the results of the division of said plurality of eighth signals by said plurality of tenth signals to establish said third signal.

13. A method in accordance with claim 12 wherein establishing a particular one of said plurality of seventh and eighth signals comprises the steps of:

establishing an eleventh signal representative of the flow rate ($F_p$) of said fluid stream;

establishing a twelfth signal representative of the specific heat ($C_p$) of said fluid stream;

multiplying said eleventh signal by said twelfth signal to establish a thirteenth signal representative of ($F_p$) ($C_p$);

establishing a fourteenth signal representative of temperature $T_0$ of the fluid stream as said fluid stream flows from said furnace;

establishing a fifteenth signal representative of the temperature $T_i$ of said fluid stream before said fluid stream enters said furnace;

subtracting said fifteenth signal from said fourteenth signal to establish a sixteenth signal representative of ($T_0-T_i$); and multiplying said thirteenth signal by said sixteenth signal to establish a particular one of said plurality of seventh and eighth signals.

14. A method in accordance with claim 13 wherein establishing a particular one of said plurality of ninth and tenth signals comprises the steps of:

establishing a seventeenth signal representative of flow rate ($F_9$) of said fuel to said furnace;

establishing an eighteenth signal representative of the BTU content ($BTU_g$) of a unit volume of said fuel; and multiplying said seventeenth signal by said eighteenth signal to establish a particular one of said plurality of ninth and tenth signals.

15. A method in accordance with claim 9 additionally comprising the steps of:

establishing a seventh signal representative of the most current measurement of the flow rate of said fuel;

lagging said seventh signal to thereby establish an eighth signal;

delaying said eighth signal to thereby establish a ninth signal;

subtracting said ninth signal from said eighth signal to establish a tenth signal;

establishing an eleventh signal representative of the volume of oxygen which must be provided to said furnace per unit volume of said fuel;

multiplying said tenth signal and said eleventh signal to establish a twelfth signal; and biasing said control signal with said twelfth signal.

16. A method in accordance with claim 15 wherein a damper is utilized to manipulate the flow of oxygen to said combusition zone and wherein said control signal biased with said twelfth signal is scaled so as to be representative of the change of position of said damper required to provide an actual oxygen concentration in said furnace flue gas substantially equal to the desired oxygen concentration represented by said fifth signal.

17. A method in accordance with claim 16 additionally comprising the steps of:

establishing a thirteenth signal representative of the most current measurement of the pressure in said furnace;

establishing a fourteenth signal representative of the maximum allowable pressure in said furnace;

comparing said thirteenth signal and said fourteenth signal and establishing a fifteenth signal which is responsive to the difference between said thirteenth signal and said fourteenth signal, wherein said fifteenth signal is scaled so as to be representative of the change of position of said damper which will maintain said actual pressure substantially equal to the maximum allowable actual pressure;

low select means;

selecting the lower of said thirteenth signal and said control signal biased by said twelfth signal to establish a sixteenth signal; and manipulating the position of said damper in response to said sixteenth signal.

* * * * *